US007472745B2

(12) United States Patent
Lynde et al.

(10) Patent No.: US 7,472,745 B2
(45) Date of Patent: Jan. 6, 2009

(54) WELL CLEANUP TOOL WITH REAL TIME CONDITION FEEDBACK TO THE SURFACE

(75) Inventors: Gerald D. Lynde, Houston, TX (US); John P. Davis, Cypress, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 5 days.

(21) Appl. No.: 11/441,420

(22) Filed: May 25, 2006

(65) Prior Publication Data

US 2007/0272404 A1 Nov. 29, 2007

(51) Int. Cl.
*E21B 31/08* (2006.01)
*E21B 12/00* (2006.01)
*E21B 27/00* (2006.01)

(52) U.S. Cl. ..... 166/99; 166/165; 166/167

(58) Field of Classification Search ..... 166/99, 166/205, 334.4, 250.01, 165, 167, 105.1
See application file for complete search history.

(56) References Cited

U.S. PATENT DOCUMENTS 3,123,157 A * 3/1964 Graham ..... 175/58
3,198,256 A * 8/1965 Kirby, II ..... 166/99
3,589,020 A 6/1971 Sullivan et al.
4,190,113 A 2/1980 Harrison
4,276,931 A 7/1981 Murray
4,515,212 A 5/1985 Krugh
4,711,299 A * 12/1987 Caldwell et al. ..... 166/105.1
4,928,758 A 5/1990 Siegfried, II (Continued)

FOREIGN PATENT DOCUMENTS

GB 2170837 A 8/1986

(Continued)

OTHER PUBLICATIONS

WorldOil.com; "Real real-time drill pipe telemetry: A step-change in drilling"; http://worldoil.com/magazine/MAGAZINE_DETAIL.asp?ART_ID=2129&MONTH_YEAR=Oct-2003; 9 pp.

(Continued)

*Primary Examiner*—Shane Bomar
(74) *Attorney, Agent, or Firm*—Steve Rosenblatt

(57) ABSTRACT

A flow sensor is incorporated into a junk basket to sense a flow stoppage due to a plugged screen or plugged cuttings ports in a mill. The sensor triggers a signal to the surface to warn personnel that a problem exists before the equipment is damaged. The sensor signal to the surface can take a variety of forms including mud pulses, a detectable pressure buildup at the surface, electromagnetic energy, electrical signal on hard wire or radio signals in a wifi system to name a few options. Surface personnel can interrupt the signal to take corrective action that generally involves pulling out of the hole or reverse circulating to try to clear the screen or mill cuttings inlets. Other variables can be measured such as the volume or weight or rate of change of either and a signal can be sent to the surface corresponding to one of those variables to allow them to be detected at the surface in near real time.

17 Claims, 5 Drawing Sheets

U.S. PATENT DOCUMENTS

| | | | | |
|---|---|---|---|---|
| 5,147,149 | A | 9/1992 | Craig et al. | |
| 5,402,850 | A | 4/1995 | Lalande et al. | |
| 6,021,377 | A | 2/2000 | Dubinsky et al. | |
| 6,065,535 | A * | 5/2000 | Ross | 166/51 |
| 6,158,512 | A * | 12/2000 | Unsgaard | 166/311 |
| 6,176,311 | B1 | 1/2001 | Ryan | |
| 6,189,617 | B1 | 2/2001 | Sorhus et al. | |
| 6,276,452 | B1 * | 8/2001 | Davis et al. | 166/298 |
| 6,310,559 | B1 | 10/2001 | Laborde et al. | |
| 6,343,651 | B1 * | 2/2002 | Bixenman | 166/278 |
| 6,446,736 | B1 | 9/2002 | Kruspe et al. | |
| 6,450,257 | B1 * | 9/2002 | Douglas | 166/250.02 |
| 6,604,582 | B2 | 8/2003 | Flowers et al. | |
| 6,607,031 | B2 | 8/2003 | Lynde et al. | |
| 6,629,564 | B1 | 10/2003 | Ramakrishnan et al. | |
| 6,637,524 | B2 | 10/2003 | Kruspe et al. | |
| 6,684,950 | B2 | 2/2004 | Patel | |
| 6,695,058 | B1 * | 2/2004 | French | 166/312 |
| 7,000,698 | B2 | 2/2006 | Mayeu et al. | |
| 7,000,700 | B2 | 2/2006 | Cairns et al. | |
| 7,188,674 | B2 * | 3/2007 | McGavern et al. | 166/298 |
| 2001/0037883 | A1 | 11/2001 | Veneruso et al. | |
| 2002/0020524 | A1 | 2/2002 | Gano | |
| 2002/0053428 | A1 * | 5/2002 | Maples | 166/99 |
| 2003/0056951 | A1 | 3/2003 | Kaszuba | |
| 2003/0127223 | A1 | 7/2003 | Branstetter et al. | |
| 2003/0196950 | A1 * | 10/2003 | Kraft | 210/322 |
| 2004/0251027 | A1 | 12/2004 | Sonnier et al. | |
| 2005/0045344 | A1 | 3/2005 | Fraser et al. | |
| 2005/0056415 | A1 | 3/2005 | Zillinger | |
| 2005/0126777 | A1 * | 6/2005 | Rolovic et al. | 166/255.1 |
| 2005/0217897 | A1 | 10/2005 | Gudac | |
| 2005/0263279 | A1 | 12/2005 | Vachon | |
| 2005/0279496 | A1 | 12/2005 | Fontenot et al. | |
| 2005/0284625 | A1 | 12/2005 | Rodney et al. | |
| 2006/0011344 | A1 * | 1/2006 | Lynde et al. | 166/298 |
| 2006/0169463 | A1 * | 8/2006 | Howlett | 166/386 |

FOREIGN PATENT DOCUMENTS

| | | | |
|---|---|---|---|
| GB | 2206508 | A | 1/1989 |
| GB | 2323871 | A | 10/1998 |
| GB | 2331536 | A | 5/1999 |
| GB | 2392688 | A | 3/2004 |
| WO | 00/58602 | A1 | 10/2000 |
| WO | 01/73262 | A2 | 10/2001 |
| WO | 03/083253 | A1 | 10/2003 |

OTHER PUBLICATIONS

Grant Prideco; http:/?www.intellipipe.com/; 2 pp.

* cited by examiner

WELL CLEANUP TOOL WITH REAL TIME CONDITION FEEDBACK TO THE SURFACE

FIELD OF THE INVENTION

The field of this invention relates to well cleanup tools that collect debris and more particularly tools that collect cuttings from milling using an eductor to draw them into the tool body.

BACKGROUND OF THE INVENTION

When milling out a tool or pipe in the well cuttings are generated that need to be removed from the milling site and collected. The bottom hole assembly that includes the mill also has what is sometimes referred to as a junk basket. These tools operate on different principles and have the common objective of separation of circulating fluid from the cuttings. This is generally done by directing the flow laden with cuttings into the tool having a catch chamber. The fluid is directed through a screen, leaving the cuttings behind. At some point the cuttings fall down into the collection volume below and outside the screen.

The operation of one type of such tool is illustrated in FIG. 1. In this known tool, flow comes from the surface through a string (not shown) and enters passage 10 in the tool 12. Flow goes through the eductor 14 and exits as shown by two headed arrow 16. Arrow 16 indicates that the exiting motive fluid can go uphole and downhole. The eductor 14 reduces pressure in chamber 18 all the way down to the lower inlet 20 on the tool 12. Arrow 22 represents fluid indicated by arrow 16 that has traveled down the annulus 24 between toll 12 and tubular 26 as well as well fluid below tool 12 that is sucked in due to the venture effect of the eductor 14. Entering fluid at lower inlet 20 goes through a tube 28 that has a hat with openings under it 30. Arrows 32 indicate the exiting flow out from under hat 30 that next goes to the outside of screen 34. At this point the cuttings are stopped by the screen 34 while the fluid goes on through and into chamber 18 as indicated by arrow 36. The stream indicated by arrow 36 blends and becomes part of the stream exiting eductor 14 as indicted by arrow 16. When flow into passage 10 is shut off, the accumulated debris on the outside of screen 34 simply falls down to around the outside of tube 28. The presence of the hat 30 keeps the debris from falling into tube 28 deflecting debris that lands on it off to the side and into the annular catch area in the tool 38.

This is how this tool is supposed to work when everything is going right. However, things don't always go right downhole and the operator at the surface using this tool in a milling operation had no information that things downhole may not be going according to plan. The main two things that can cause problems with this type of tool or any other junk basket tool is that the screen 34 can clog with debris. Those skilled in the art will appreciate that flow downhole in annulus 24 goes all the way down to the mill and enters openings in the mill to reach lower inlet 20 of the tool 12. If the screen clogs the downhole component of the flow indicated by arrow 16 stops. As a result, there is a diminished or a total lack of flow into the mill ports to remove the cuttings and take away the heat of milling. The mill can overheat or get stuck in cuttings or both. If the mill sticks and turning force is still applied from the surface, the connections to the mill can fail. Sometimes, without clogging screen 34, the mill can create cutting shapes that simply just ball up around the mill. Here again, if the balling up occurs, flow trying to go downhole in annulus 28 will be cut off. The inlet openings for the cuttings in the mill may become blocked limiting or cutting off flow into lower inlet 20.

What the operator needs and currently doesn't have is a way to know that a condition has developed downhole at the mill or at the screen 34 that needs to be immediately addressed to avoid downhole equipment failure. While some operator with enough experience cleaning up a hole may be able to do this by gut feel in certain situations like removing sand, using gut feel is not reliable and in milling as opposed to simple debris cleanout, rules of thumb about how fast the bottom hole assembly moves into sand when removing it from the wellbore are simply useless.

What is needed and provided by the present invention is a real time way to know if anything has gone wrong downhole in time to deal with the issue before the equipment is damaged. The tool of the present invention is able to sense flow changes through it and communicate that fact in real time to the surface. Those and other aspects of the present invention will become apparent to those skilled in the art from a review of the description of the preferred embodiment, the drawings and the claims which outline the full scope of the invention.

SUMMARY OF THE INVENTION

A flow sensor is incorporated into a junk basket to sense a flow stoppage due to a plugged screen or plugged cuttings ports in a mill. The sensor triggers a signal to the surface to warn personnel that a problem exists before the equipment is damaged. The sensor signal to the surface can take a variety of forms including mud pulses, a detectable pressure buildup at the surface, electromagnetic energy, electrical signal on hard wire or radio signals in a wifi system to name a few options. Surface personnel can interrupt the signal to take corrective action that generally involves pulling out of the hole or reverse circulating to try to clear the screen or mill cuttings inlets. Other variables can be measured such as the volume or weight or rate of change of either and a signal can be sent to the surface corresponding to one of those variables to allow them to be detected at the surface in near real time.

DETAILED DESCRIPTION OF THE DRAWINGS

DETAILED DESCRIPTION OF THE PREFERRED EMBODIMENT

Figure 1:
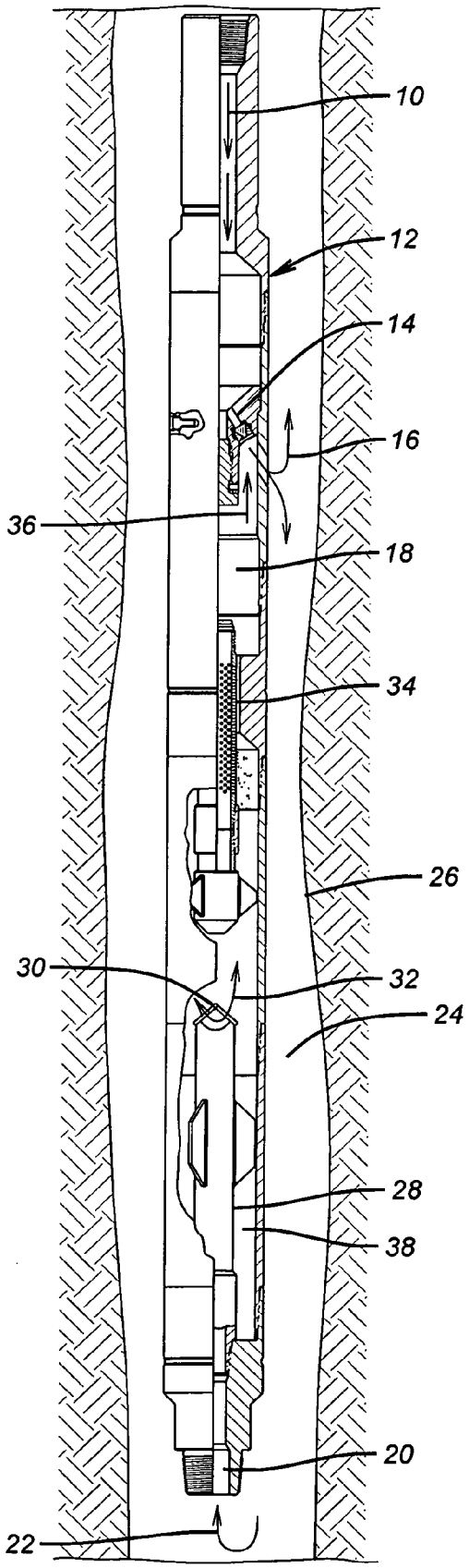
(PRIOR ART) FIG. 1
FIG. 1 is a section view of a prior art junk basket that uses an eductor to capture cuttings within.
Figure 2:
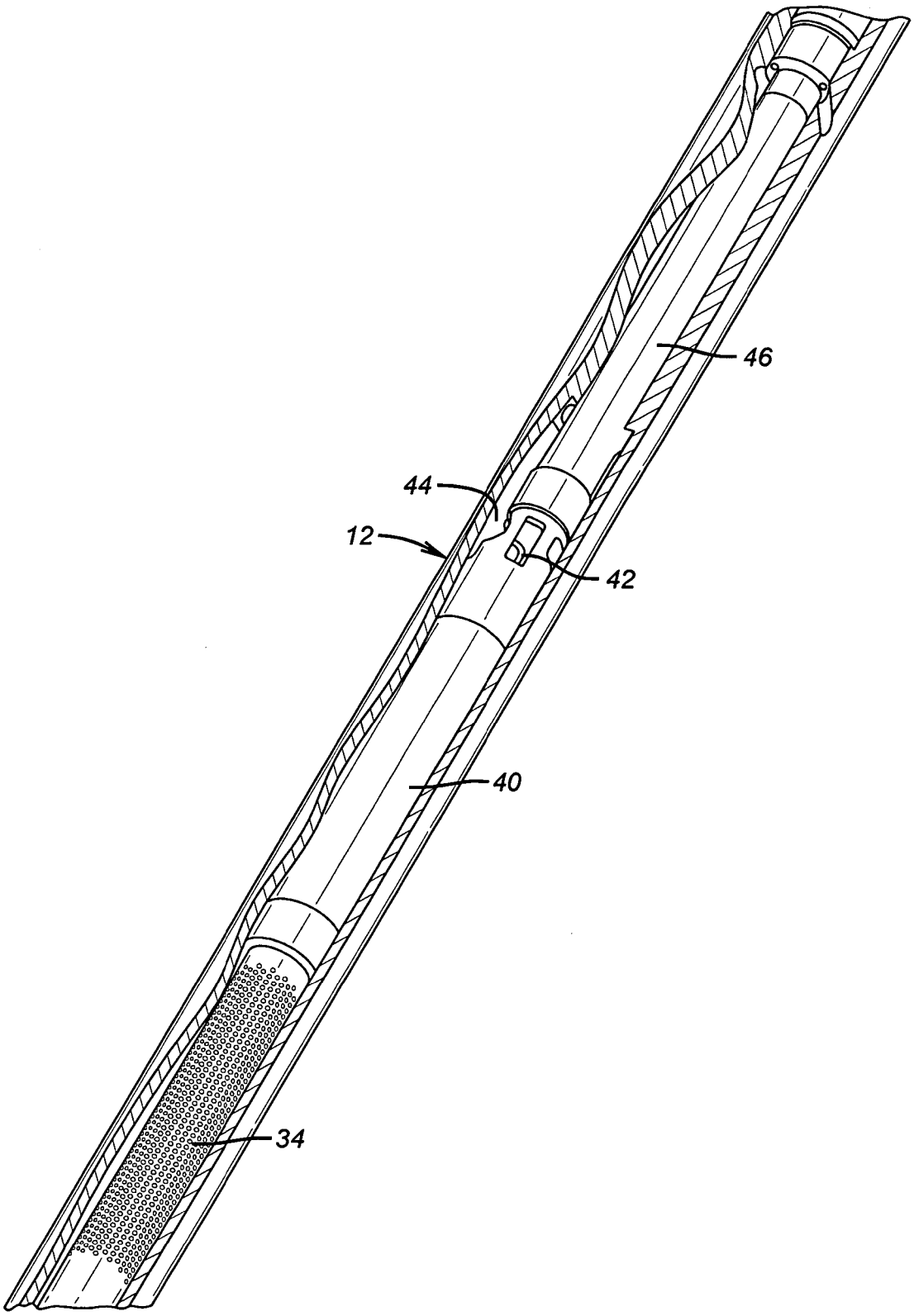
FIG. 2 shows how the junk basket of FIG. 1 is modified to sense flow.

The operation of one type of such tool is illustrated in FIG. 1. In this known tool, flow comes from the surface through a string (not shown) and enters passage 10 in the tool 12. Flow goes through the eductor 14 and exits as shown by two headed arrow 16. Arrow 16 indicates that the exiting motive fluid can go uphole and downhole. The eductor 14 reduces pressure in chamber 18 all the way down to the mill and lower inlet schematically represented as 20 on the tool 12. Arrow 22 represents fluid indicated by arrow 16 that has traveled down the annulus 24 between tool 12 and tubular 26 as well as well fluid below tool 12 that is sucked in due to the venturi effect of the eductor 14. Entering fluid at lower inlet 20 goes through a tube 28 that has a hat with openings under it 30. Arrows 32 indicate the exiting flow out from under hat 30 that next goes to the outside of screen 34. At this point the cuttings are stopped by the screen 34 while the fluid goes on through and into chamber 18 as indicated by arrow 36. The stream indicated by arrow 36 blends and becomes part of the stream exiting eductor 14 as indicted by arrow 16. When flow into passage 10 is shut off, the accumulated debris on the outside of screen 34 simply falls down to around the outside of tube 28. The presence of the hat 30 keeps the debris from falling into tube 28 deflecting debris that lands on it off to the side and into the annular catch area in the tool 38.

With sleeve 54' on ports 50, closing of the ports 50 responsive to a sensed low flow will result in a reverse flow measured at sensor 40. An electronic pulse generator mounted above eductor 14 can then be signaled by sensor 40, now measuring a reverse flow, to send pulses to the surface to be interpreted there as an indication of reverse flow. A reverse flow signal indicates to surface personnel that the screen 34 has been cleared in a reverse direction and therefore should be operated again in the normal direction by opening valve 54' using a surface signal or the processor associated with motor 46. The operator can pick up and cut the pump off to reset the system and then kick the pump back on and set down weight to see if a positive direction flow is established.

Figure 4:
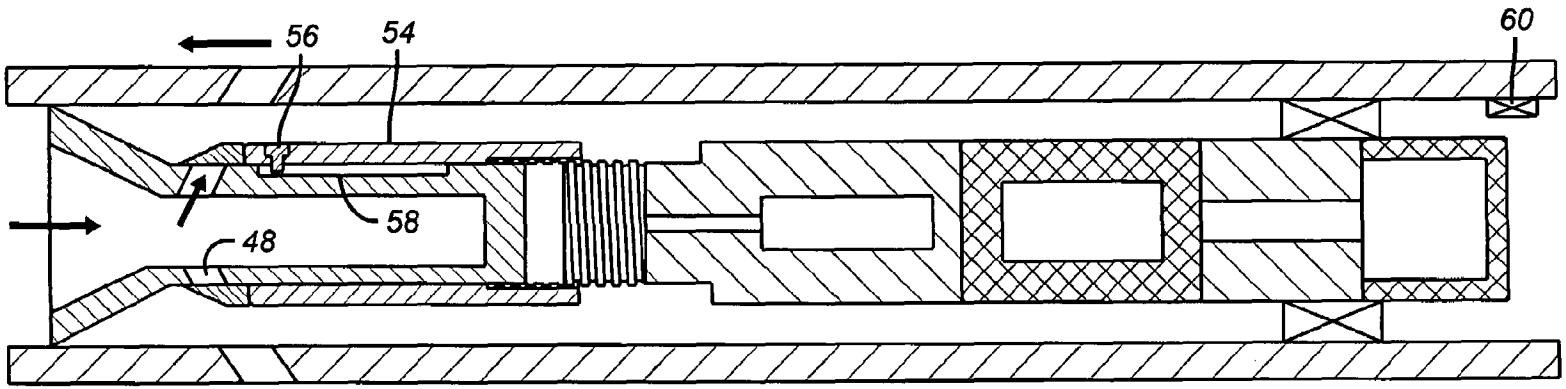
FIG. 4 shows that a low flow condition causes the motor to move the sleeve to cover a port to give a pulse signal or a simple pressure spike signal to the surface.

When a low flow is sensed at flow sensor 40 the motor 46 runs and the sleeve 54 is driven over the ports 48 as shown in FIG. 4. These Figures show two types of signals to the surface to warn of a low flow condition within the tool 12. Depending on the speed of the sleeve 54 and whether or not it is programmed to reverse direction, the surface signal can be a rapid pressure buildup or it can be pulses through the well fluids picked up by a surface sensor and converted into a flow reading. If the sleeve simply moves to cover the ports 48 and a positive displacement pump is used at the surface, it will simply build up pressure at the surface. Upon seeing that, surface personnel will turn the pump off with the hope that the cuttings on the screen 34 or in the ports in the mill will simply fall into the annular catch region 38 or further downhole, respectively. At the same time as cutting off the surface pump, the operator can lift the mill to stop the milling process. The string can be rotated with the mill lifted to help cuttings come off the mill or settle down into the catch region 38. After doing that the operator can resume pumping and look for feedback in the sensed flow transmitted to the surface as mud pulses and converted to flow readings by surface equipment. If flows resumes to normal levels after a system reset that pulls the sleeve 54 off of openings 48, the milling can resume. If normal flow rates are not detected at flow meter 40 and the ports 48 continue to be obstructed, the operator will again see higher pressures than normal at the pump on the surface. This will tell the operator to pull the string out of the hole to see what the problem may be. Ideally, the flow rate through the tool 12 for carrying the cuttings to the screen is preferred to be in the order of about 150 feet per minute and this can realized with a flow from the surface of about 4-8 barrels a minute. At that flow rate from the surface the total flow rate through ports 50 is about twice the pump rate from the surface.

Apart from a pressure surge that can be seen at the surface from sleeve movement covering ports 48, the sleeve 54 can be cycled over and then away from ports 48 to create a pattern of pressure pulses in the string going to the surface. A sensor can be placed on the string near the surface and the pulses can be converted into a visual and/audible signal that there is a flow problem downhole using currently available mud pulse technology.

Figure 3:
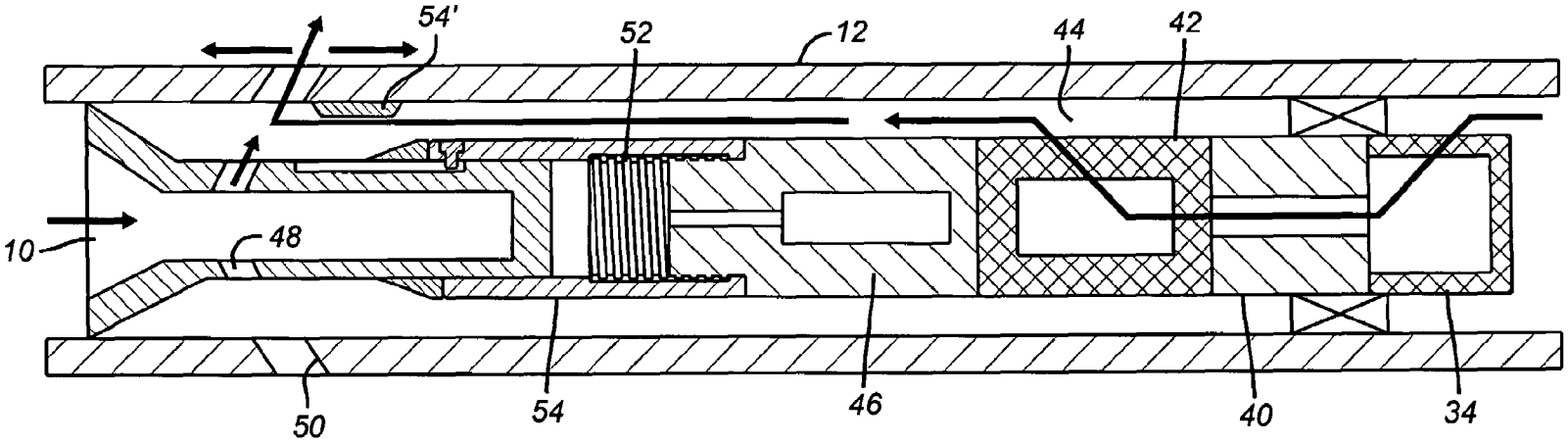
FIG. 3 shows how the flow meter is operably connected to a movable sleeve shown in the Figure in its normal fully open position.

Referring to FIGS. 3 and 4, the gear drive 52 can be a ball screw or a thread whose rotation results in translation of the sleeve 54 since sleeve 54 is constrained from rotating by pin 56 in groove 58.

Figure 6:
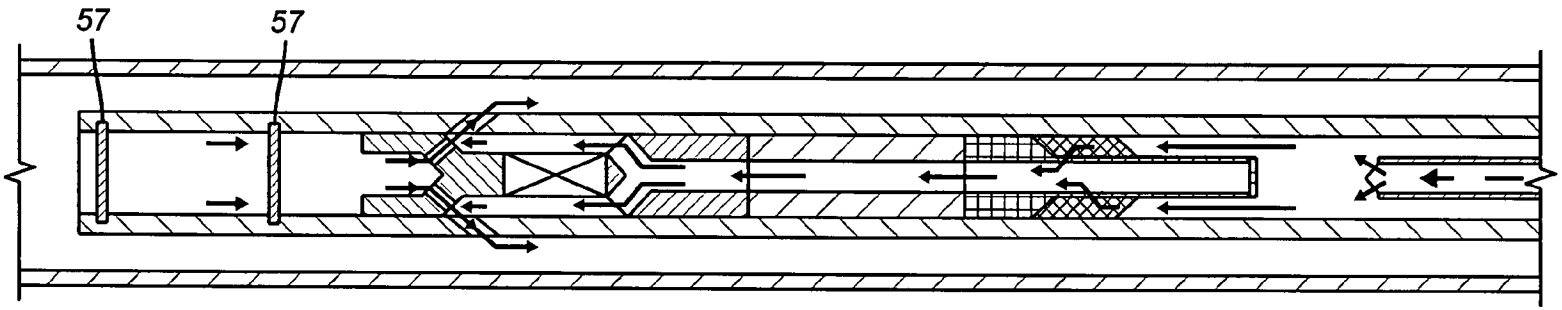
FIG. 6 is an alternative to FIG. 5 where a system of wireless communicators allows surface personnel to know the flow through the tool in real time.
Figure 7:
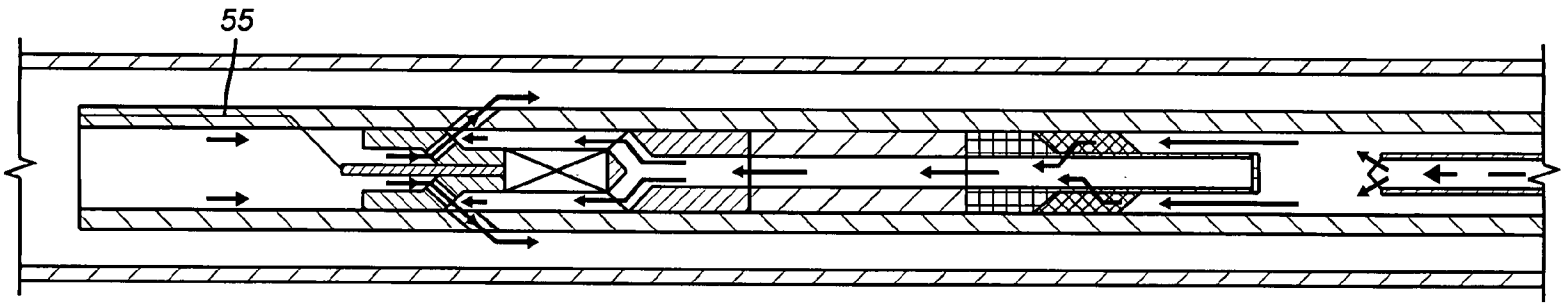
FIG. 7 shows an embedded electrical pathway as the way the flow is communicated to the surface in real time.
Figure 8:
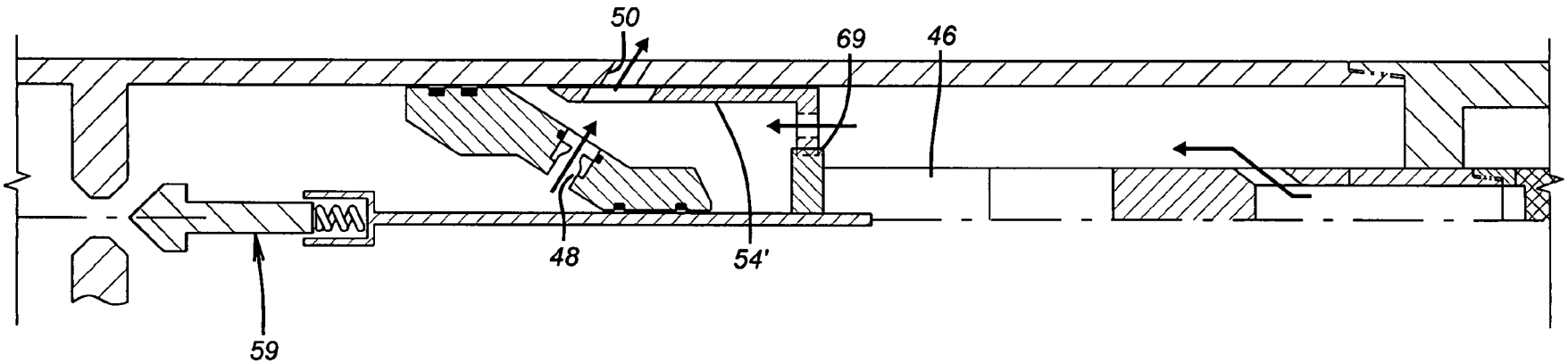
FIG. 8 shows a combination of a pulser and an outlet valve to signal flow to the surface and to reverse flow the screen in an effort to resolve the problem.
Figure 9:
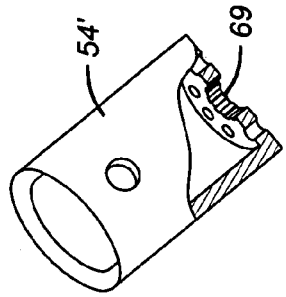
FIG. 9 is a view of the sleeve 54' shown in FIG. 8.

Signals of low flow can be communicated to the surface by wire in a variety of known techniques one of which is drill pipe telemetry 55 offered by IntelliServe a joint venture corporation of Grant Prideco and Novatek and shown schematically in FIG. 7. Alternatively electromagnetic signals can be wirelessly sent to the surface to communicate the flow conditions downhole as shown schematically in item 57 in FIG. 6. The flow sensing can be directly coupled to a signaling device. For example if the flow sensor is a prop mounted on a ball screw and acted on by a spring bias. The flow through the prop can push it against the spring bias and hold the ports 48 for the eductor 14 in the open position. If the flow slows or stops, the biasing member can back the prop assembly on the ball screw mount. The sleeve 54 can move in tandem with the prop on the ball screw mount so that a slowdown in flow closes openings 48 to give a surface signal as described above.

Figure 5:
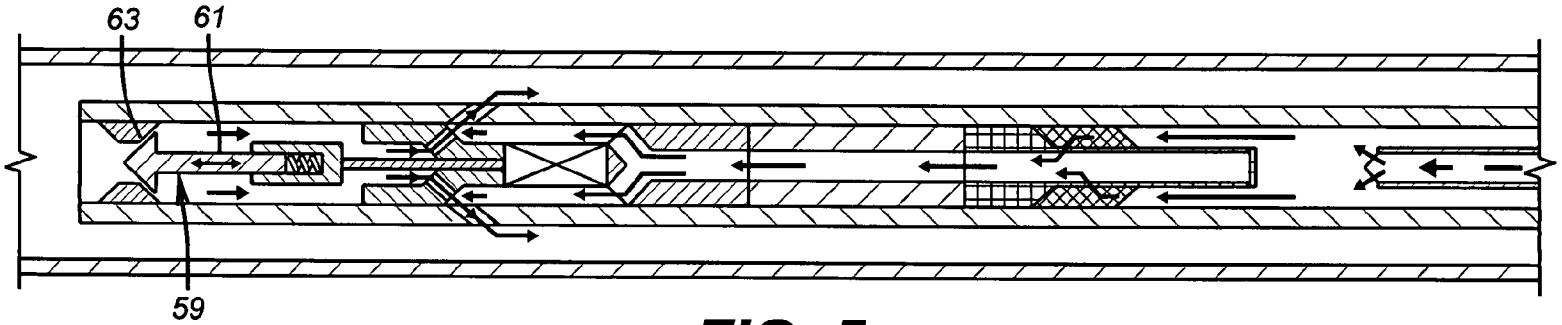
FIG. 5 shows a mud pulser assembly as the signaling to the surface of the flow through the tool measured in real time.

FIG. 5 shows a pulser 59 in the form of a reciprocating valve member 61 that is operated to go on and off a seat 63 in response to a sensed flow as discussed before. In this embodiment a sliding sleeve such as 54 is not used because the pulser 59 is there. However, a sleeve 54' can still be used to create a reverse flow to attempt to clear the screen, as discussed above.

Other indicators of potential problems can be the volume of cuttings being accumulated in the catch annular space 38 or their weight or the rate of change of either variable. A sensor 60 to detect the cuttings level or rate of change per unit time can be mounted near the screen 34 or in the space 38 to sense the level and trigger the same signal mechanism to alert surface personnel to pull out of the hole. Similarly, the annular space 38 can have a receptacle mounted on a weight sensor so that the accumulated weight or its rate of change can be detected. Signals can be sent if the weight increases to a predetermined amount or fails to change a predetermined amount over a predetermined time period. In either case the operator may know that the expected amount of debris has been collected or for some reason no debris is being collected. Signals such as mud pulses can differ depending on the condition sensed. The level or weight indication can be used alone or together with the flow sensing. If both are used one can back up the other because a high collected debris condition can also lead to flow reduction through the tool. In that sense, the reading of one can validate the other. Alternatively the reading of one can be a backup to the other if there is a failure in one of the systems.

The above description is illustrative of the preferred embodiment and many modifications may be made by those skilled in the art without departing from the invention whose scope is to be determined from the literal and equivalent scope of the claims below.

We claim:

1. A milling debris catching tool for downhole use in a tubular string from the surface, comprising:

a mill adapted to pass a predetermined fluid flow rate to remove cuttings from a milled object;

a tool body having at least one inlet and outlet and a milling debris receptacle;

a screen in a passage between said inlet and outlet to accept debris laden fluid and to prevent milling debris from passing through the tool so that it can be retained in said receptacle;

a sensor to detect how flow through said screen from said inlet to said outlet compares to the predetermined rate, said sensor operably connected to a valve member in said tool and selectively reconfiguring said passage for flow from said outlet to said inlet in an effort to unclog said screen if flow from said inlet to said outlet through said screen is below said predetermined rate.

2. The tool of claim 1, comprising:

a signal transmitter to transmit a signal responsive to the sensed flow from said sensor.

3. The tool of claim 2, wherein:

said signal comprises changing the pressure in a portion of said body that is in fluid communication with the string which is interpretable as an indication of low flow through said body.

4. The tool of claim 3, further comprising:

a port in said body in fluid communication with the string and aligned with said outlet, said aligned port and outlet spanning a portion of said passage that leads from a clean side of said screen where debris has been screened out to said outlet.

5. The tool of claim 4, wherein:

said valve member comprises a sleeve to selectively block said port;

said sleeve driven by a motor responsive to said sensor.

6. The tool of claim 4, wherein:

said valve member comprises a sleeve to selectively block said outlet aligned with said port while still allowing flow through it, whereupon flow in said spanned portion of said passage can reverse back to said screen.

7. The tool of claim 6, wherein:

said sensor measures reverse flow when said sleeve selectively closes;

said body further comprising a pulse generator responsive to a reverse flow measurement in said sensor to send a pulse signal related to the reverse flow rate measured.

8. The tool of claim 5, wherein:

movement of said sleeve with respect to said port creates a pulse signal indicative of the measured flow rate by said sensor.

9. The tool of claim 5, wherein:

movement of said sleeve with respect to said port creates a pressure spike in said body as a surface signal that sensed flow is low.

10. The tool of claim 2, wherein:

said signal comprises changing said pressure in a portion of said body that is in fluid communication with said string in a predetermined pattern to create a mud pulse signal interpretable into a surface flow reading.

11. The tool of claim 2, wherein:

said signal comprises an electrical signal and further comprising a conduit for said signal extending from said body to the surface.

12. The tool of claim 2, wherein:

said signal is at least one of an electromagnetic signal and a radio wave.

13. The tool of claim 2, further comprising:

a second sensor in said body to detect one of the volume and weight of the debris captured in said body;

said signal transmitter transmitting a signal from said body responsive to the volume or weight of debris retained in said body or the rate of change thereof.

14. The tool of claim 13, wherein:

said second sensor comprises a proximity sensor or a weight sensor.

15. A debris catching tool for downhole use in a tubular string from the surface, comprising:

a body having at least one inlet and outlet;

a screen in a passage between said inlet and outlet to prevent debris from passing through the tool;

a sensor to detect the weight or volume or rate of change of debris, captured in said body;

a signal transmitter to transmit a signal responsive to the weight, volume or rate of change of debris, measured by said sensor;

said signal comprises changing said pressure in a portion of said body that is in fluid communication with said string in a predetermined pattern to create a mud pulse signal interpretable into a surface reading of weight or volume or rate of change of debris;

a port in said body in fluid communication with the string and aligned with said outlet, said aligned port and outlet spanning a portion of said passage that leads from a clean side of said screen where debris has been screened out to said outlet; and a valve member on at least one of said port and said outlet movable responsive to said sensor.

16. The tool of claim 15, wherein:

said valve member comprises a sleeve to selectively block said port;

said sleeve driven by a motor responsive to said sensor.

17. The tool of claim 15, wherein:

said valve member comprises a sleeve to selectively block said outlet;

said outlet, when closed, allowing reverse flow through said screen.

* * * * *